US007182220B2

(12) United States Patent
Raposo

(10) Patent No.: US 7,182,220 B2
(45) Date of Patent: Feb. 27, 2007

(54) PITCHER FOR HOLDING FLEXIBLE BAGS OF MILK OR OTHER LIQUIDS

(76) Inventor: Peter Raposo, 88 Palace Pier Ct., Unit 909, Toronto, Ontario (CA) M8V 4C2

( * ) Notice: Subject to any disclaimer, the term of this patent is extended or adjusted under 35 U.S.C. 154(b) by 312 days.

(21) Appl. No.: 10/981,554

(22) Filed: Nov. 5, 2004

(65) Prior Publication Data

US 2006/0096943 A1 May 11, 2006

(51) Int. Cl.
*B65D 35/56* (2006.01)
*A47G 19/12* (2006.01)

(52) U.S. Cl. ..... 222/105; 222/183; 222/465.1

(58) Field of Classification Search ..... 222/105, 222/183, 465.1
See application file for complete search history.

(56) References Cited

U.S. PATENT DOCUMENTS 3,096,912 A * 7/1963 Rivette ..... 222/183
4,203,567 A * 5/1980 Featherstone ..... 248/108
4,247,020 A * 1/1981 Desjardins ..... 222/83.5
4,463,876 A * 8/1984 Swallert ..... 222/94
4,653,671 A * 3/1987 Duffy et al. ..... 222/105
4,671,427 A 6/1987 Farquharson ..... 222/83.5
5,141,134 A 8/1992 Machado ..... 222/83.5
2002/0117514 A1* 8/2002 Allanson et al. ..... 222/105
2003/0192909 A1* 10/2003 Maskell ..... 222/103

FOREIGN PATENT DOCUMENTS

CA 2160386 4/1997

* cited by examiner

*Primary Examiner*—Joseph A. Kaufman
(74) *Attorney, Agent, or Firm*—Merek, Blackmon & Voorhees, LLC

(57) ABSTRACT

A pitcher for holding flexible bags filled with milk or other liquids. The pitcher comprises a substantially rigid housing having a bottom, sides and a generally open top forming a generally hollow interior capable of receiving therein a flexible bag filled with liquid. The housing is dimensioned so that at least a portion of the bag extends upwardly through the open top when the bag is received within the hollow interior. At least one bag clamping member is attached to the housing and is movable between an engaged position and a disengaged position. When it is in its disengaged position the clamping member is generally adjacent to the sides of the housing. When it is in its engaged position the clamping member extends upwardly from the open top of the housing and is releasably securable to a portion of a bag received within the hollow interior of the housing to assist in maintaining the bag in an upright configuration.

17 Claims, 5 Drawing Sheets

PITCHER FOR HOLDING FLEXIBLE BAGS OF MILK OR OTHER LIQUIDS

FIELD OF THE INVENTION

This invention relates to pitchers that may be used to hold and support flexible bags, such as those that are commonly used to store and dispense milk, juices and other liquids.

BACKGROUND OF THE INVENTION

With the advancement of packaging technology, over the years the method of packaging and selling liquids (such as milk, juices, motor oil, etc.) has progressed from the use of rigid glass, metallic, plastic or cellulose containers, to the more common approach where such liquids are sealed within thin walled flexible bags formed from plastic or other materials. Today, the use of such bags to distribute and sell milk, juices and other liquids is a common place. Typically the bags are of a standardized size and volume (for example one quart or one liter) to allow them to fit into standardized jugs or pitchers. Most commonly, individual bags are inserted into a jug or pitcher with the upper portion of the bag extending beyond the top of the pitcher so that a corner of the bag can be cut or removed to allow for the dispensing of the liquid.

While literally millions of such pitchers have been sold, and countless millions of bags manufactured for use in such pitchers, the dispensing of liquid in the described fashion continues to suffer from a number of inherent limitations. Not the least of these limitations occurs when the bag has been initially opened and is full, or substantially full, of fluid. As mentioned, manufacturers of existing pitchers have typically constructed them so that they are somewhat shorter than the length of the bag of milk or fluid to be received therein. Constructing pitchers in this manner permits a few inches of the bag to extend through the top of the pitcher, making it easier for the consumer to grasp a corner of the bag and cut it with a pair of scissors or a knife in order to access the fluid therein. Making the pitcher shorter than the length of the bag also helps to facilitate the insertion and removal of the bag into and out of the pitcher. However, when a bag is full, or substantially full, and when fluid is being dispensed from a cut corner, there is a natural tendency for the bag to "flop" forward towards the open cut corner, sometimes causing an uncontrolled flow of liquid. In addition, as fluid is dispensed from the bag, the bag has a tendency to collapse upon itself, often making it difficult to extract the last bit of fluid from the bottom of the bag. In such circumstances consumers often discard the remaining fluid within the bag or resort to removing the bag completely from the pitcher and attempting to manually extract any fluid that is left in its bottom. Neither of these options is desirable and both present the possibility of lost fluid, uncontrolled flow, and/or spillage.

SUMMARY OF THE INVENTION

The invention therefore provides a pitcher for holding flexible plastic or other bags, such as those that may be used to hold milk, juices and other liquids, that presents a mechanism by which the bag can be retained in position within the pitcher in order to help prevent the uncontrolled flow of fluid from the bag, and to also help assist in extracting fluid when the bag becomes substantially empty.

Accordingly, in one of its aspects the invention provides a pitcher for holding flexible bags filled with milk or other liquids, the pitcher comprising: a substantially rigid housing having a bottom, sides and a generally open top forming a generally hollow interior capable of receiving therein a flexible bag filled with liquid, said housing dimensioned such that at least a portion of said bag extends upwardly through said open top when said bag is received within said hollow interior; and, at least one bag clamping member attached to said housing and movable between an engaged position and a disengaged position, when in said disengaged position said clamping member generally adjacent to the sides of said housing, when in said engaged position said clamping member extending upwardly from said open top of said housing and releasably securable to a portion of a bag received within said hollow interior of said housing to assist in maintaining said bag in an upright configuration.

In a further aspect the invention provides a pitcher for holding flexible bags filled with liquid, the pitcher comprising: a substantially rigid housing having an open top and a generally hollow interior for receiving a flexible bag filled with liquid, said housing dimensioned such that at least a portion of said bag extends upwardly through said open top when said bag is received within said hollow interior; and, a pair of clamping members attached to said housing and moveable from a disengaged position wherein said clamping members are generally adjacent to the sides of said housing to an engaged position wherein said clamping extend upwardly from said open top of said housing, when in said engaged position said clamping members releasably securable to one another and to an upper portion of a bag received within said hollow interior to assist in maintaining said bag in an upright configuration.

The invention also concerns a pitcher for holding flexible bags filled with liquid, the pitcher comprising: a substantially rigid housing having an open top and a generally hollow interior capable of receiving therein a flexible bag filled with liquid, said housing dimensioned such that at least a portion of said bag received within said hollow interior extends upwardly through said open top; and, a pair of clamping members, each of said clamping members having a first and a second end, said first ends of said clamping members attached to opposite sides of said housing, said clamping members movable from a disengaged position where they are generally adjacent to the sides of said housing to an engaged position where said second ends of said clamping members engage each other and engage an upper portion of a bag filled with liquid received within said hollow interior of said housing to assist in maintaining said bag in an upright configuration.

In another aspect the invention provides a pitcher for holding flexible bags filled with liquid, the pitcher comprising: a housing having an open top and a generally hollow interior for receiving a flexible bag filled with liquid, said housing dimensioned such that at least a portion of said bag extends upwardly through said open top when said bag is received within said hollow interior; and, a pair of clamping members hingedly attached to opposite sides of said housing and moveable between a disengaged position, wherein said clamping members are generally adjacent to the sides of said housing, and an engaged position, wherein said clamping members extend upwardly from said open top of said housing, when in said engaged position said clamping members releasably securable to one another and to an upper portion of a bag received within said hollow interior to assist in maintaining said bag in an upright configuration.

In yet a further aspect the invention provides a pitcher for holding flexible bags filled with liquid, the pitcher comprising: a housing having an open top and a generally hollow interior for receiving a flexible bag filled with liquid, said housing dimensioned such that at least a portion of said bag extends upwardly through said open top when said bag is received within said hollow interior; a pair of clamping members, each of said clamping members having a first and a second end, said first ends of said clamping members hingedly attached to opposite sides of said housing, said clamping members moveable between a disengaged position, wherein said clamping members are generally adjacent to the sides of said housing, and an engaged position, wherein said clamping members extend upwardly from said open top of said housing, when in said engaged position said clamping members releasably securable to one another and to an upper portion of a bag received within said hollow interior to assist in maintaining said bag in an upright configuration; and, a locking member to releasably secure said second ends of said clamping members together when said clamping members are in said engaged position.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
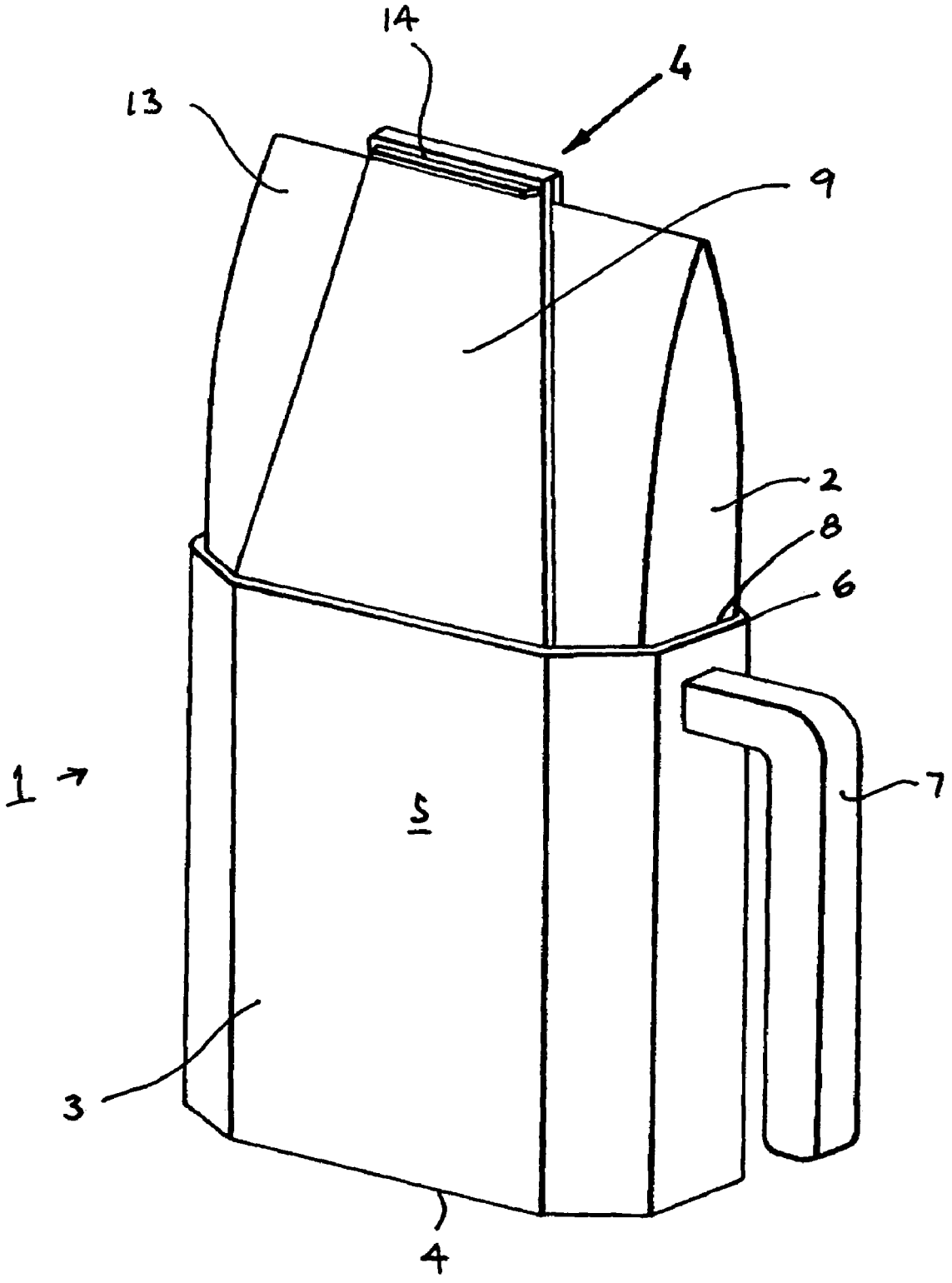
FIG. 1 is an upper side perspective view of a pitcher in accordance with one of the preferred embodiments of the present invention wherein the pitcher has received therein a flexible plastic bag of liquid.

The attached drawings show preferred embodiments of a pitcher constructed in accordance with the present invention. For example, FIG. 1 shows such a pitcher 1 that is in use in association with a flexible bag 2, as is commonly used to hold milk, juices, or other liquids. Pitcher 1 is comprised generally of a substantially rigid housing 3 having a bottom 4, one or more side surfaces 5 and a generally open top 6. To aid in the grasping and transportation of the pitcher, housing 3 may also include a handle 7. It will be appreciated that the particular shape and configuration of the housing may vary while remaining within the broad scope of the present invention. For example, the sides of the housing shown in FIG. 1 are generally planer and configured in this embodiment in a generally octagonal form. However, the cross sectional shape of housing 3 could equally be of a different geometric configuration, including a generally elliptical shape.

Of importance to the design of the pitcher is its generally hollow interior 8 which is capable of receiving therein a bag filled with liquid. Since in most applications the flexible bags that will be used in association with the pitcher will be of a generally standardized volume (for example one quart or one liter), it is expected that in most instances the general size and dimensions of housing 3 will be similarly standardized. The overall height of the housing is preferably such that at least a portion of bag 2 extends upwardly through the housing's open top when the bag is received within the housing's hollow interior. As mentioned previously, allowing at least part of the bag to extend upwardly through the housing facilitates the insertion of the bag into the hollow interior, assists in the removal of the bag when its contents have been emptied, and makes it easier for a consumer to gain access to a corner that can be cut to dispense fluid from the bag. Allowing the bag to extend beyond the top of the pitcher also provides a visual indicator with respect to the volume of fluid left in the bag when the bag is formed from transparent or translucent material. As is common with currently available pitchers that receive flexible bags filled with liquids, housing 3 may be formed from a wide variety of different materials, including plastics, metals, and ceramics.

In accordance with the invention, pitcher 1 further includes at least 1 bag clamping member 9 attached to housing 3 and movable between an engaged position and a disengaged position. When clamping member 9 is in its disengaged position (see FIG. 3) it will be generally adjacent to sides 5 of housing 3. When in its engaged position, clamping member 9 extends upwardly from the open top of the housing to releasably secure a portion of bag 2, and to thereby assist in maintaining the bag in an upright configuration. To accommodate movement of clamping member 9 between its engaged and disengaged positions, the clamping member is preferably attached to the housing by means of a hinged or slidable connection. In the embodiment shown in FIGS. 1, 2 and 3, a pair of clamping members are utilized, each of which are attached to opposite sides of housing 3 by means of a hinge 10. In this instance hinge 10 may be any variety of currently available hinging structures ranging from standard piano-type hinges to flexible "living" hinges that may be formed from plastic or other material. In an alternate embodiment hinge 10 may be a spring hinge, tending to bias the clamping members toward their engaged position.

Figure 3:
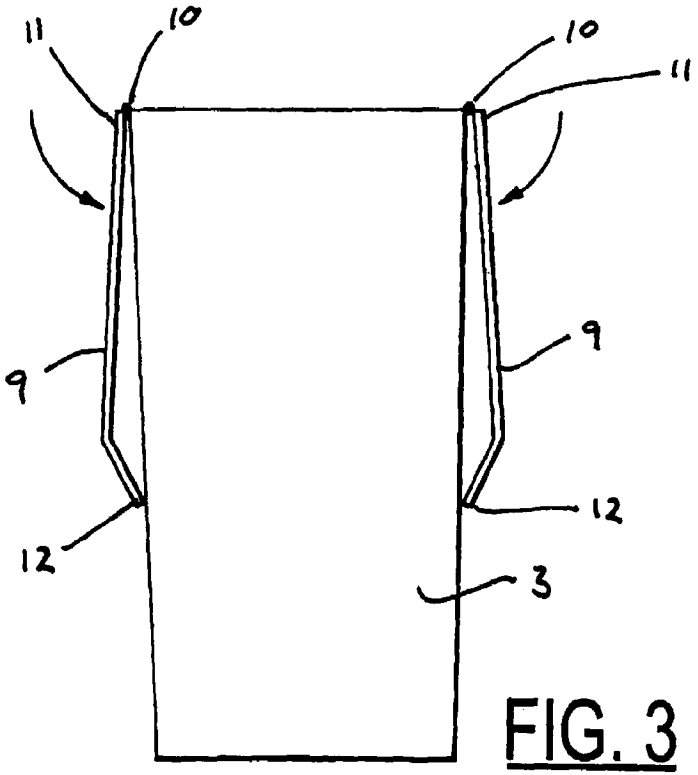
FIG. 3 is a side elevational view of the pitcher shown in FIG. 2 having its clamping members rotated downwardly and in a disengaged position.
Figure 2:
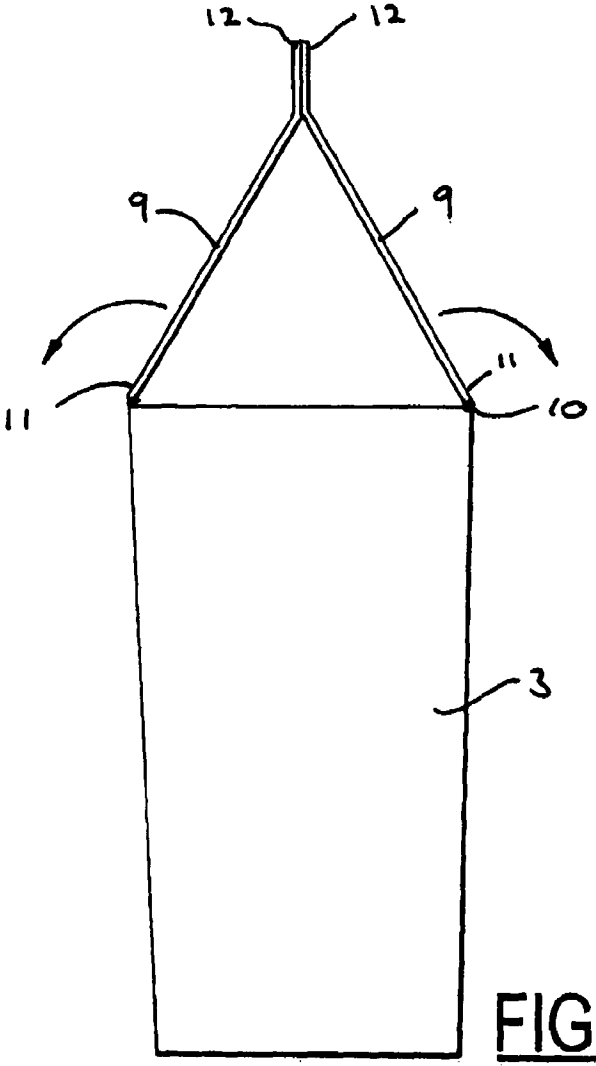
FIG. 2 is a front elevational view of the pitcher of FIG. 1 with its clamping members in an upward engaged position.

Referring once again to the preferred embodiment of the invention that is shown in FIGS. 1, 2 and 3, each of the clamping members 9 have first and second ends, 11 and 12 respectively. The first ends 11 of the clamping members represent those portions that are hingedly (or otherwise) attached to opposite sides of housing 3. The second, distal, ends of the clamping members are configured such that they are engageable with one another when the clamping members are in their engaged position (see FIGS. 1 and 2). In addition, clamping members 9 are dimensioned such that when a bag is received within the hollow interior of housing 3, the engagement of second ends 12 will cause the ends of the clamping members to also engage an upper portion of the bag, thereby helping to hold the bag in place and to maintain the bag in an upright configuration.

While many structures may be utilized to releasably secure the upper end or an upper portion of the bag to clamping members 9, in the embodiment shown in the attached drawings an upper portion 13 of flexible bag 2 is received or sandwiched between the second ends 12 of clamping members 9 (see FIG. 1) when the clamping members are in their engaged positions. Squeezing or sandwiching an upper portion of the bag between the respective second ends of the clamping members will thus help keep the bag upright within housing 3 and prevent it from "flopping" over and resulting in uncontrolled flow from a cut corner. Removal of the bag from the housing requires the movement of clamping members 9 from their engaged to their disengaged positions. Similarly, the insertion of a bag into hollow interior 8, and the subsequent holding or clamping of its upper portion, merely requires the movement of clamping members 9 from their disengaged to their engaged position.

It will be appreciated by those skilled in the art having a thorough understanding of the invention that holding or maintaining the upper end or an upper portion of bag 2 between second ends 12 of clamping members 9 may be accomplished in a number of different ways. Preferably some form of locking member 14 is utilized in order to hold the upper portion of the bag in place. Locking member 14 may itself range in structure from a spring or spring mechanism located at the point of attachment of the clamping members to the and housing, to a more complex mechanical lock. That is, as indicated previously the attachment of the clamping members to the housing may incorporate a spring or equivalent structure tending to bias the clamping members to their engaged position and creating a force that drives second ends 12 toward one another. Alternately, locking member 14 may comprise a mechanical clamp received about or upon the exterior of one or both of second ends 12. Three such mechanical clamping structures are shown in the attached drawings.

Figure 7:
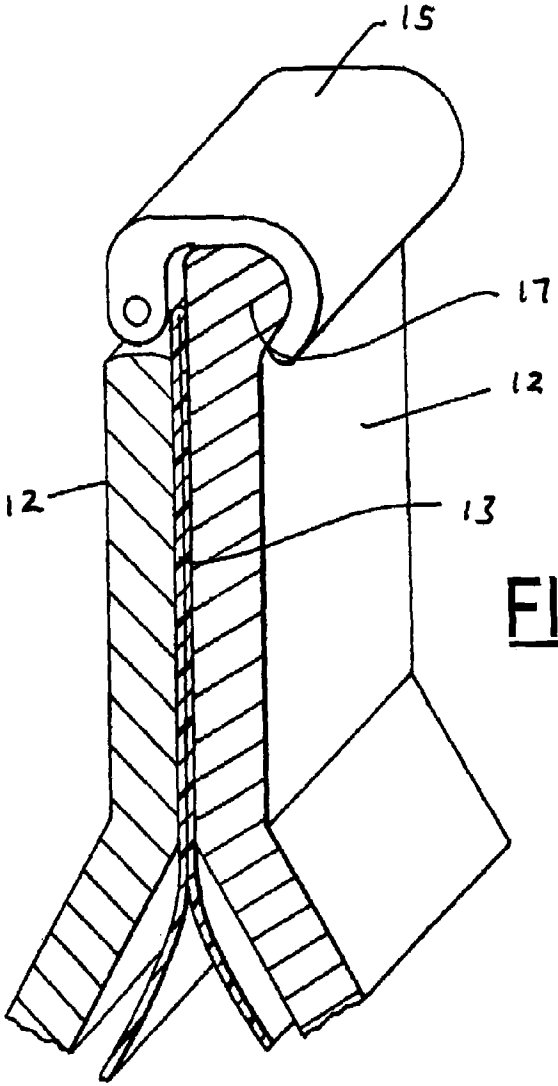
FIG. 7 is a detailed view of the upper portion of the clamping members shown in FIG. 6 in section and in an engaged configuration.
Figure 6:
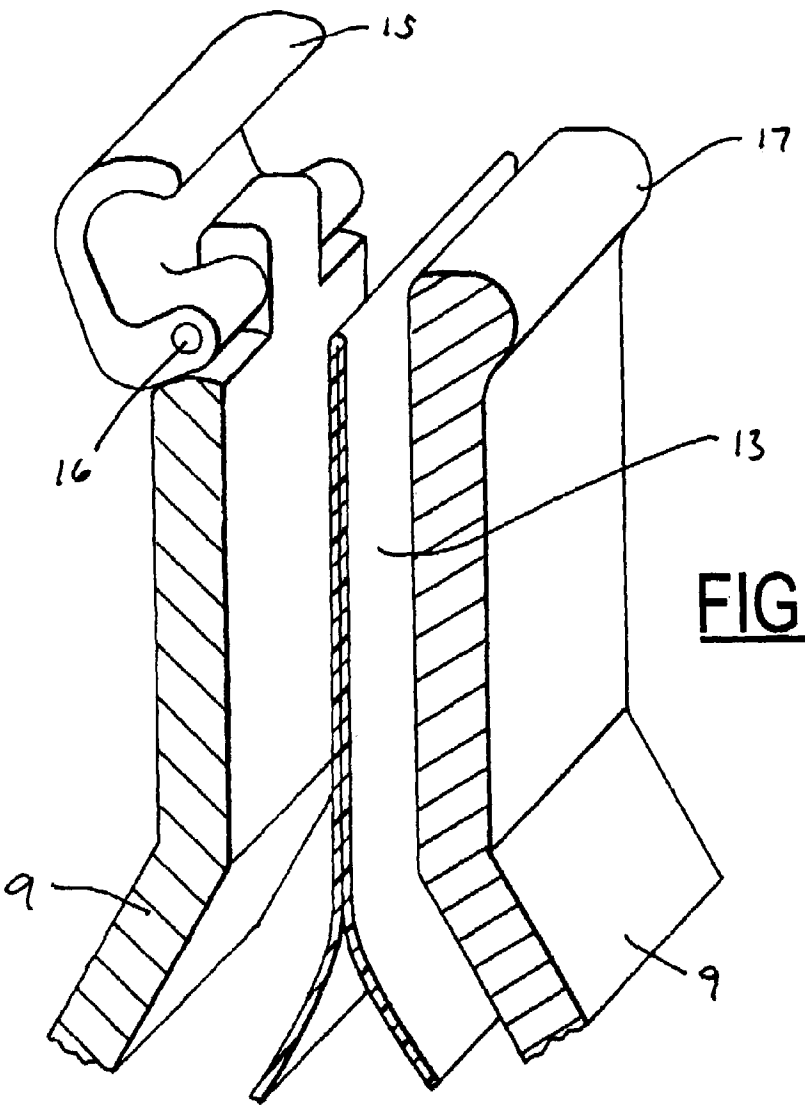
FIG. 6 is a detailed view of an alternate embodiment of the upper portion of the clamping members shown in FIG. 1 in section and prior to engagement.

In the embodiment of the invention shown in FIGS. 6 and 7, locking member 14 comprises a mechanical clamp 15 that is rotationally received upon second end 12 of one of the clamping members 9. In this embodiment mechanical clamp 15 is secured to the end of one of the clamping members by means of a pin 16 that permits the clamp to be rotated thereabout. As shown, mechanical clamp 15 is preferably of a "C" or clam shell type configuration such that when clamping members 9 are in their engaged position, rotating mechanical clamp 15 allows its clam shell structure to engage a raised lip or ridge 17 upon the second end 12 of the opposing clamping member, thereby holding the upper ends of the two clamping members together and retaining an upper portion of flexible bag 2 therebetween.

Figure 5:
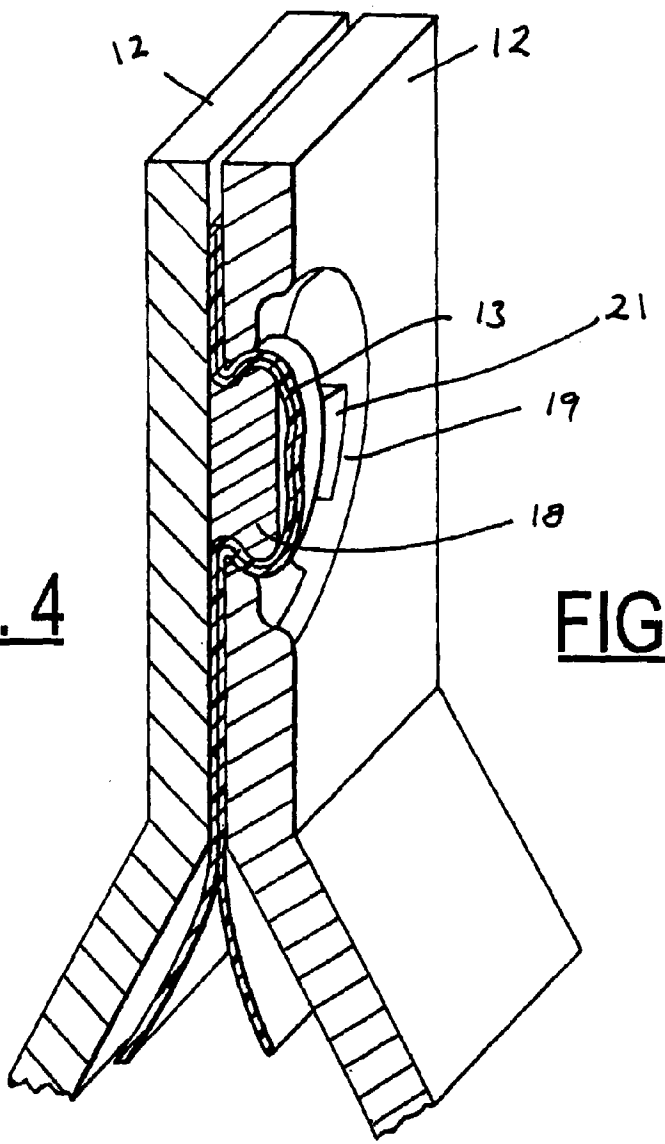
FIG. 5 is a detailed view of the upper portion of the clamping members of FIG. 4 in section and in an engaged configuration.
Figure 4:
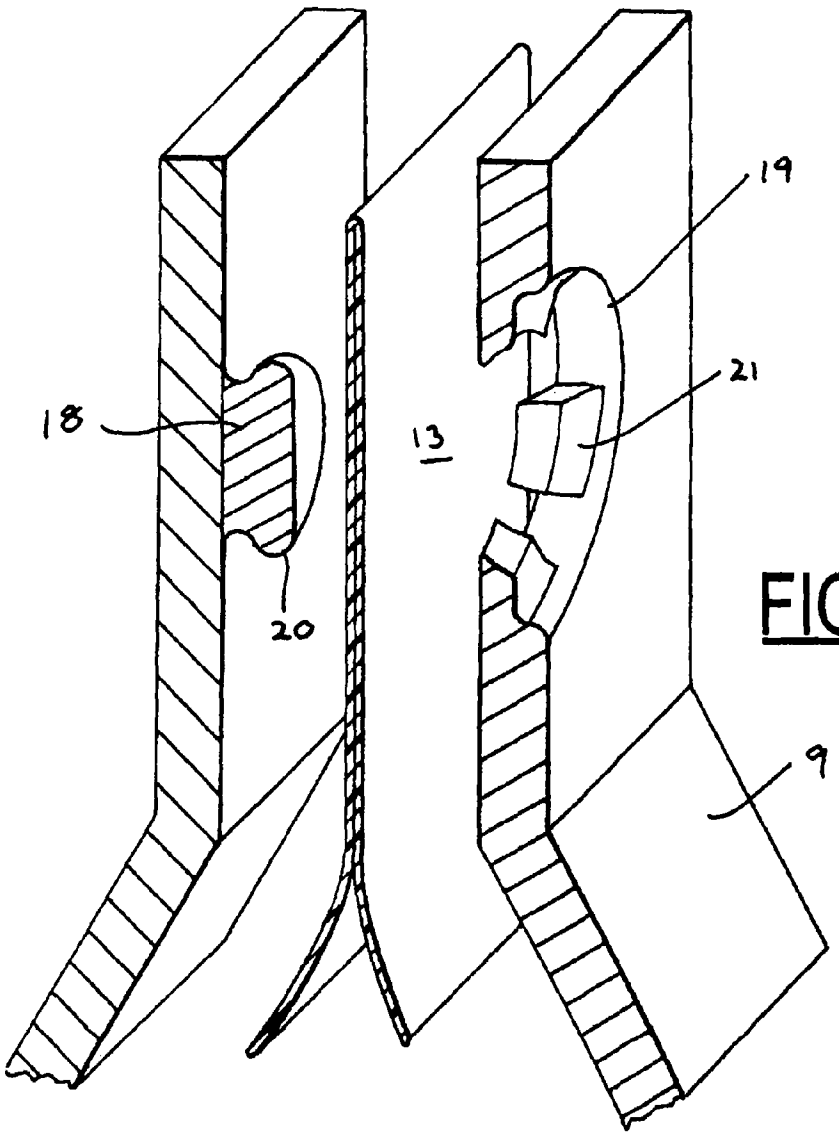
FIG. 4 is a detailed view of the upper portion of one embodiment of the clamping members of FIG. 1 in section and prior to engagement.
Figure 9:
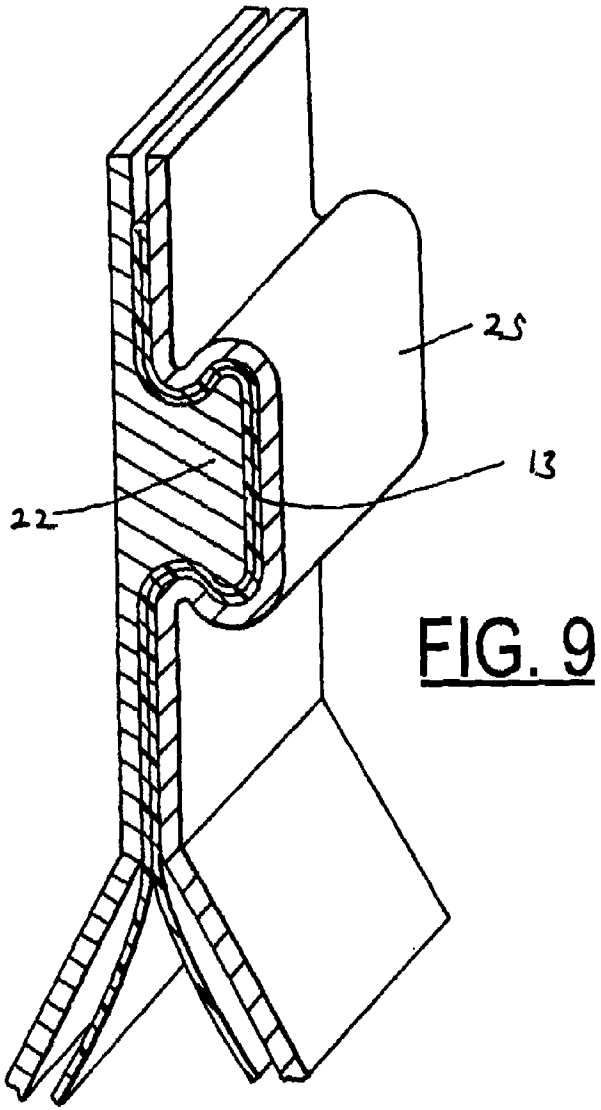
Figure 8:
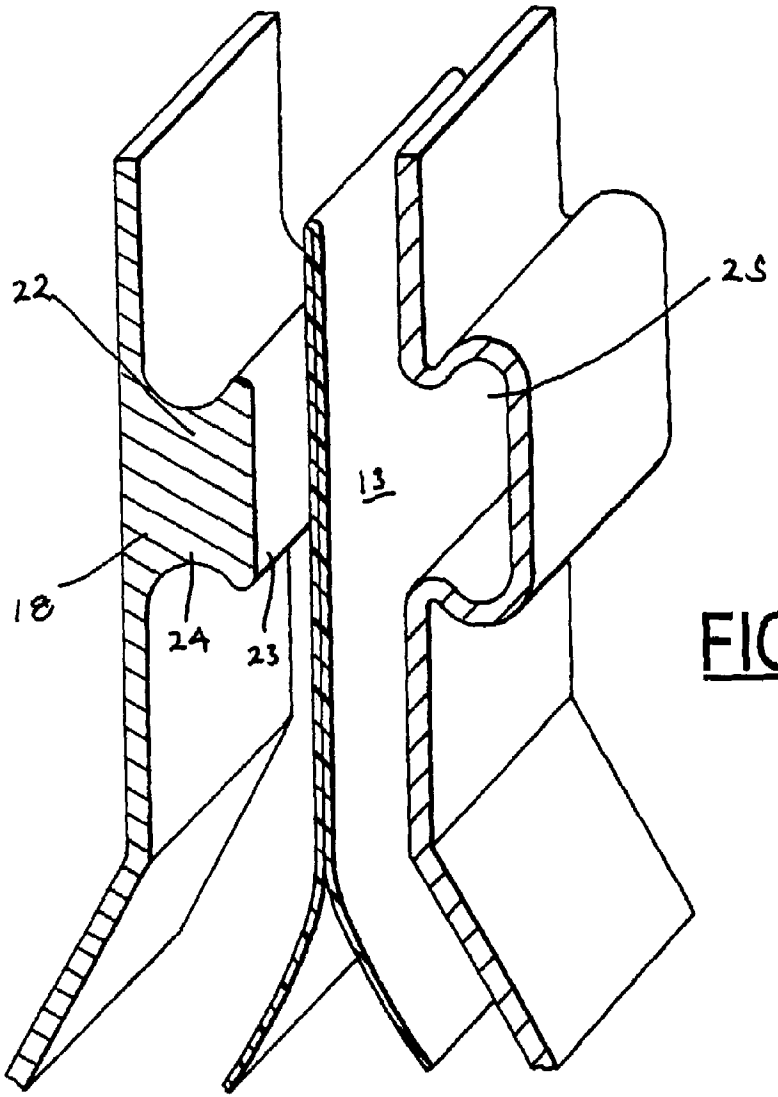
FIG. 8 is a detailed view of a further alternate embodiment of the upper portion of the clamping members shown in FIG. 1 in section and prior to engagement; and, FIG. 9 is a detailed view of the upper portion of the clamping members shown in FIG. 8 in section and in an engaged configuration.

Alternate forms of locking member 14 are shown in the embodiments depicted in FIGS. 4 and 5, and also in FIGS. 8 and 9. In these embodiments locking member 14 comprises one or more spigots 18, located upon the second end of one of the clamping members, and one or more corresponding sockets 19, located upon the second end of the other clamping member. The spigots and sockets are designed and dimensioned such that the spigots may be frictionally received within the sockets when the clamping members are in their engaged position. Receipt of the spigots within the sockets thereby releasably secures the ends of the clamping members together.

A variety of different structures may be utilized to accomplish the engagement of the spigots and sockets. In the embodiment shown in FIGS. 4 and 5, the spigots are formed having a raised bulbous structure 20 that is received within a socket having a plurality of flexible tabs 21. As the spigot is pushed into the socket, tabs 21 deflect until the spigot is fully deployed into the socket's opening, at which time tabs 21 will engage a smaller necked down portion of the spigot to help secure the spigot in place. Both the spigot and socket are preferably dimensioned to permit the material from which flexible bag 2 is formed to encompass the spigot and to be driven into the socket upon the engagement of clamping members 9, thereby securely holding the bag in an upright configuration.

FIGS. 8 and 9 show a slight variation to the structure of the locking member that is depicted in FIGS. 4 and 5. Here the spigot comprises an elongate rib 22 extending laterally along a portion of the second end 12 of one of the clamping members. As in the case of bulb 20 in FIG. 4, rib 22 of FIG. 8 has an enlarged outer portion 23 and a smaller intermediary neck 24. The second end of the opposite clamping member is formed with an elongate channel 25 into which rib 22 may be snapped to releasably hold the two ends of the clamping members together. Once again, as in the case of the embodiment shown in FIGS. 4 and 5, rib 22 and channel 25 are preferably dimensioned to permit an upper portion of flexible bag 2 to encompass rib 24 and be driven into channel 25 when the clamping members are engaged.

It will thus be understood that the described invention provides a means to readily support a flexible bag filled with milk or other liquid received within a pitcher. Through supporting the bag in an upright configuration the ability to pour liquid from the bag is considerably enhanced and the likelihood of spillage reduced. The invention further enhances the ability to evacuate the contents of the bag while minimizing the likelihood of a loss or spillage of fluid, and provides a fast and reliable mechanism to both clamp and unclamp the bag in place so that empty bags may be easily removed and fresh bags quickly inserted. With its clamping members in their disengaged position and generally adjacent to the sides of the pitcher, the invention also permits the pitcher to be stored or transported in essentially the same fashion and physical space as currently available pitchers that are devoid of any such clamping members. In addition, the invention also permits clamping members to be applied to pre-existing pitchers. Doing so merely requires the attachment of one or more clamping members to the side of a pre-existing pitcher. Attaching the clamping members may be accomplished in a number of ways, including through the use of an adhesive to secure a portion of a piano or living hinge on first end 11 of the clamping member to the side or upper portion of the housing.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A pitcher for holding flexible bags filled with milk or other liquids, the pitcher comprising:

a substantially rigid housing having a bottom, sides and a generally open top forming a generally hollow interior capable of receiving therein a flexible bag filled with liquid, said housing dimensioned such that at least a portion of said bag extends upwardly through said open top when said bag is received within said hollow interior; and, at least one bag clamping member attached to said housing and movable between an engaged position and a disengaged position, when in said disengaged position said clamping member generally adjacent to the sides of said housing, when in said engaged position said clamping member extending upwardly from said open top of said housing and releasably securable to a portion of a bag received within said hollow interior of said housing to assist in maintaining said bag in an upright configuration.

2. The device as claimed in claim 1 wherein said clamping member is hingedly attached to said housing.

3. The device as claimed in claim 1 wherein said clamping member is slidably attached to said housing.

4. The device as claimed in claim 1 wherein said housing includes a handle.

5. The device as claimed in claim 1 including a pair of clamping members, said clamping members hingedly attached to opposite sides of said housing.

6. The device as claimed in claim 5 wherein each of said clamping members has a first and a second end, said first ends of said clamping members hingedly attached to opposite sides of said housing, said second ends of said clamping members engaging each other and engaging an upper portion of a bag of liquid received within said hollow interior of said housing when said clamping members are in said engaged position.

7. The device as claimed in claim 6 including a locking member to releasably secure said second ends of said clamping members together.

8. The device as claimed in claim 7 wherein said locking member comprises a mechanical clamp receivable about the exterior of said second ends of said clamping members.

9. The device as claimed in claim 7 wherein said locking member comprises a frictional engagement of said second ends of said clamping members.

10. A pitcher for holding flexible bags filled with liquid, the pitcher comprising:

a substantially rigid housing having an open top and a generally hollow interior for receiving a flexible bag filled with liquid, said housing dimensioned such that at least a portion of said bag extends upwardly through said open top when said bag is received within said hollow interior; and, a pair of clamping members attached to said housing and moveable from a disengaged position wherein said clamping members are generally adjacent to the sides of said housing to an engaged position wherein said clamping extend upwardly from said open top of said housing, when in said engaged position said clamping members releasably securable to one another and to an upper portion of a bag received within said hollow interior to assist in maintaining said bag in an upright configuration.

11. A pitcher for holding flexible bags filled with liquid, the pitcher comprising:

a substantially rigid housing having an open top and a generally hollow interior capable of receiving therein a flexible bag filled with liquid, said housing dimensioned such that at least a portion of said bag received within said hollow interior extends upwardly through said open top; and, a pair of clamping members, each of said clamping members having a first and a second end, said first ends of said clamping members attached to opposite sides of said housing, said clamping members movable from a disengaged position where they are generally adjacent to the sides of said housing to an engaged position where said second ends of said clamping members engage each other and engage an upper portion of a bag filled with liquid received within said hollow interior of said housing to assist in maintaining said bag in an upright configuration.

12. A pitcher for holding flexible bags filled with liquid, the pitcher comprising:

a housing having an open top and a generally hollow interior for receiving a flexible bag filled with liquid, said housing dimensioned such that at least a portion of said bag extends upwardly through said open top when said bag is received within said hollow interior; and, a pair of clamping members hingedly attached to opposite sides of said housing and moveable between a disengaged position, wherein said clamping members are generally adjacent to the sides of said housing, and an engaged position, wherein said clamping members extend upwardly from said open top of said housing, when in said engaged position said clamping members releasably securable to one another and to an upper portion of a bag received within said hollow interior to assist in maintaining said bag in an upright configuration.

13. A pitcher for holding flexible bags filled with liquid, the pitcher comprising:

a housing having an open top and a generally hollow interior for receiving a flexible bag filled with liquid, said housing dimensioned such that at least a portion of said bag extends upwardly through said open top when said bag is received within said hollow interior;

a pair of clamping members, each of said clamping members having a first and a second end, said first ends of said clamping members hingedly attached to opposite sides of said housing, said clamping members moveable between a disengaged position, wherein said clamping members are generally adjacent to the sides of said housing, and an engaged position, wherein said clamping members extend upwardly from said open top of said housing, when in said engaged position said clamping members releasably securable to one another and to an upper portion of a bag received within said hollow interior to assist in maintaining said bag in an upright configuration; and, a locking member to releasably secure said second ends of said clamping members together when said clamping members are in said engaged position.

14. The device as claimed in claim 13 wherein said locking member comprises a mechanical clamp receivable about the exterior of said second ends of said clamping members.

15. The device as claimed in claim 13 wherein said locking member comprises a mechanical clamp rotationally received upon the second end of one of said clamping members, said mechanical clamp rotationally engaging the second end of the other of said clamping members when said clamping members are in said engaged position.

16. The device as claimed in claim 13 wherein said locking member comprises a spring biasing said second ends of said clamping members toward one another.

17. The device as claimed in claim 13 wherein said locking member comprises one or more spigots, located upon the second end of one of said clamping members, and one or more corresponding sockets, located upon the second end of the other of said clamping members, when said clamping members are in their engaged position said one or more spigots frictionally received within said one or more sockets.

* * * * *